United States Patent [19]

Larson

[11] Patent Number: 4,967,721

[45] Date of Patent: Nov. 6, 1990

[54] CABLE ANCHOR SYSTEM FOR COMPOUND ARCHERY BOWS

[75] Inventor: Marlow W. Larson, Ogden, Utah

[73] Assignee: Browning, Morgan, Utah

[21] Appl. No.: 423,019

[22] Filed: Oct. 18, 1989

[51] Int. Cl.[5] ..... F41B 5/00

[52] U.S. Cl. ..... 124/25.6; 124/900

[58] Field of Search ..... 124/23 R, 24 R, 90, 124/DIG. 1, 23.1, 25.6, 25.7, 900

[56] References Cited

U.S. PATENT DOCUMENTS

| | | | |
|---|---|---|---|
| 3,958,551 | 5/1976 | Ketchum | 124/90 X |
| 4,333,443 | 6/1982 | Roelle | 124/24 R |
| 4,478,203 | 10/1984 | Hayes | 124/24 R |
| 4,561,413 | 12/1985 | Jennings | 124/23 R |
| 4,774,927 | 10/1988 | Larson | 124/23 R |
| 4,838,236 | 6/1989 | Kudlacek | 124/23 R |

OTHER PUBLICATIONS

1989 Pearson Archery Catalog (cover and pp. 3 and 5).
1989 Hoyt Archery Catalog (cover and pp. 1 and 2).

*Primary Examiner*—Randolph A. Reese
*Assistant Examiner*—Jeffrey L. Thompson
*Attorney, Agent, or Firm*—Trask, Britt & Rossa

[57] ABSTRACT the end stretch cables of the rigging for a compound bow are provided as take-up and let-off segments which attach to opposite ends of a cross-bolt anchor member jounraled through the eccentrics of the rigging.

24 Claims, 3 Drawing Sheets

CABLE ANCHOR SYSTEM FOR COMPOUND ARCHERY BOWS

BACKGROUND OF THE INVENTION

1. Field

This invention relates to compound archery bows and more particularly relates to the rigging for such bows. It is specifically directed to an improved system for connecting the cable elements of such a rigging to the eccentric elements of such a rigging.

2. State of the Art

Compound archery bows are currently available in a variety of configurations. They are most generally configured substantially as illustrated in the original patent to Allen, U.S. Pat. No. 3,486,495. As so configured, the compound bow includes a handle, a pair of limbs extending from opposite ends of the handle to present spaced opposed limb tips, and a pair of eccentric elements rotatably mounted on eccentric axes associated with the respective limb tips. The eccentrics and limb tips are interconnected by a rigging system which includes the eccentrics and stretches of cabling or similar tension runs constructed of aircraft cable or bowstring materials. The cabling includes a central stretch, generally including the bowstring, and a pair of end stretches. Each end stretch extends from attachment at one limb tip across the bow handle to attachment with the eccentric member mounted at the opposite limb tip.

Although a great deal of development has occurred with respect to the specific configuration of eccentric elements utilized with compound bows of modern design, most of the currently available eccentric elements include a take-up cam and a let-off cam in approximately side-by-side relation. Each of those cams conventionally carries a cable receiving peripheral groove about at least a portion of its perimeter. The groove should proceed around that portion of the perimeter which is contacted by cable at any stage of the draw of the nocking point of the bowstring from its at-rest position to its fully drawn position. An axle journal, which may be a simple hole or a hole with an appropriate bushing in place, is provided approximately transverse the take-up and let-off cams at a location eccentric with respect to the geometric center of the eccentric element. The terms "take-up" and "let-off" refer to winding or unwinding, respectively, of stretches of the cabling.

Compound bows include a rigging whereby each of the eccentrics of a matched pair of eccentrics is connected to an end stretch, typically formed of aircraft cable or similar material. Each end stretch cable includes a let-off segment which extends from a let-off groove of the let-off cam and a take-up cable segment extending from a take-up groove of the take-up cam on the opposite side of the eccentric element. Thus, in assembly, the end stretch cable must be inserted into a bore or comparable cable passageway extending from one of the peripheral grooves through the interior of the eccentric to exit from a corresponding cable passageway communicating with the opposite peripheral groove.

The free end of the take-up portion of the cable is adapted for connection to structure associated with one of the limb tips. In most instances it is provided with a large loop which may be connected to the limb tip by placement over an axle or within a clamp carried near the limb tip. Similarly, the let-off portion of the end stretch cable is specially adapted for attachment to a bowstring. Typically, it is so adapted by carrying a special fixture called a "tear drop" at its end. Both this tear drop fixture and any corresponding fixture carried by the end of the take-up portion of the cable require special tools and techniques for proper attachment. Special techniques and materials are also required to fashion a reliable loop in the end of a cable portion. Accordingly, it is beyond the capabilities of a typical archer to replace the worn or broken cables of a compound archery bow without professional help.

Because it is necessary for the cable to be inserted through the eccentrics prior to fastening the loop or fixtures at the end of the take-up and let-off portions extending from the eccentric, it has not heretofore been feasible in most instances for an archer to order replacement cables from a supplier without ordering an entire rigging, including the eccentrics. The other alternative available to an archer is to return the eccentrics of his bow to a manufacturer or a pro shop for the professional replacement of the end stretch cables. Replacement of cables in the field following a cable breakage has been impractical and unfeasible.

It has long been recognized that an end stretch may be discontinuous; i.e., provided in segments. Individual segments may be connected individually to an eccentric. Such arrangements have generally been factory assembled by means requiring professional assembly techniques. In other instances, individual let-off and take-up segments of an end stretch cable have been connected to an eccentric by means which are inherently dangerous. Thus, in the event of a cable breakage, individual components of such systems may actually be propelled as hazardous projectiles. Some modern rigging systems are particularly susceptible to breakage, in which event "tear drops" and similar fixtures are hazardous.

Some modern cable systems deliberately avoid the use of metal cables for the end stretches. The bowstring materials used in such systems tend to stretch and twist. Thus, it is difficult to properly time peep sights carried by the central stretch.

There remains a need for a rigging system by which the end stretch cables may be replaced by an archer without the need for professional assistance. There also remains a need for a less hazardous rigging system generally. There also remains a need for such a rigging which retains the ability to utilize metal cable end stretch segments.

SUMMARY OF THE INVENTION

The present invention provides an improved rigging for a compound archery bow comprising generally a pair of eccentric elements each of which includes a take-up cam and a let-off cam in approximately side-by-side relation, each cam having a cable receiving peripheral groove about at least a portion of its perimeter and an axle journal approximately transverse the cams in conventional fashion.

The eccentric elements are provided with a first cable passageway between the peripheral groove of the take-up cam and a first chamber which is internal the eccentric. A second cable passageway is provided between the peripheral groove of the let-off cam and a second chamber internal the eccentric. Both of the internal chambers are accessible from outside the eccentric but are separated from each other by a structural member.

The structural member generally comprises a wall common to the two chambers with ports through the wall to permit communication of the chambers necessary for the passage of cables and other structures. An anchor member is journaled through the structural member and is positioned with a first end within the first chamber and second end within the second chamber. The first end of the anchor member and the first chamber within which it is positioned will usually be associated with the take-up cam and the second end of the anchor member and the second chamber within which it is positioned will normally be associated with the let-off cam, although in certain embodiments those associations may be reversed.

The rigging of this invention further comprises a pair of cables, each cable of the pair being associated with one of the eccentrics of the pair of eccentrics in the rigging. Each of the cables individually includes a take-up segment and a let-off segment. These two cable segments are individually connected to the anchor member positioned within the anchor passage of the structural member.

In the preferred embodiments, the anchor member is fixed to one of the cable segments and the other segment is releasably attachable to the anchor member internal the eccentric. While the cable segments may be separate structural components, it is currently highly preferred that the let-off segment be provided integral with the central stretch of the rigging, thereby avoiding the requirement for a mechanical connection device (such as the conventional "tear drop" fixture) between the cables and the bowstring. Because the anchor member is contained by the eccentric, in the event of cable breakage, the hazard associated with tear drop connectors is avoided.

The take-up segment typically includes a first end adapted for connection to structure associated with the other eccentric of the pair of eccentrics within the rigging. This structure may be the axle upon which the other eccentric is mounted, or it may be a fixture connected to the bow limb with which the other eccentric is associated. In any event, the take-up segment includes a second end which is positioned within the eccentric. This second end of the take-up segment extends from the peripheral groove of the take-up cam through a first cable passageway to the first chamber. Within the first chamber it is connected to the previously mentioned first end of the anchor member.

The let-off segment, if not integral with the central stretch of the rigging, includes a first end which is adapted for connection to a bowstring, typically by means of a conventional "tear drop" connector. It further includes a second end positioned within the eccentric. This second end of the take-up segment extends from the peripheral groove of the let-off cam through the second cable passageway associated with that cam to the second chamber. Within the second chamber it is connected to the second end of the anchor member.

It is generally preferred that the second end of either the let-off or take-up segments of the end stretch cable be permanently fixed to an anchor member. The anchor member of the eccentric may then be regarded as a disposable interchangeable part so that when new cables are required, a replacement anchor member is provided as a fixture attached to one end (the second end) of one of the cable segments. In that event, the cable passageway for that segment is formed as a groove rather than a bore. The cable may then be positioned appropriately between the peripheral groove and the anchor passage when the anchor member is positioned within the anchor passage. The second end of the other segment of the end stretch cable may be removably attached to the other end of the anchor member after it is positioned within the anchor passage. It is generally preferred that the let-off segment be permanently fixed to the anchor member, although according to other embodiments the second end of the take-up segment may be permanently fixed to the anchor member, and in still other embodiments the anchor member is removably connectable to both segments.

The anchor member is journaled within the anchor passage. It carries first registration structure while the anchor passage includes second registration structure. These first and second registration structures are cooperatively adapted so that the anchor member can pass from one to the other of the first and second chambers through the anchor passage only when the anchor member is rotated to a registration position. Once positioned with its first and second ends in their corresponding first and second chambers, the anchor member is rotated to an other than registration position. It can thus not be withdrawn from its installed position.

One of the particular benefits of fixing the second end of one of the cable segments to the anchor member is that when the cable is positioned within its cable passageway, the rotational orientation of the anchor member is fixed. By properly locating the first registration means carried by the anchor member with the respect to the second registration structure associated with the anchor passage, the anchor member is reliably held in an out-of-registration position, thereby insuring against its dislodgement. In other words, once the anchor member and cable segments are installed, the normal rotational orientation of the anchor member is inevitably in an other than registration position. It is preferable to connect the second end of the other end stretch cable segment to the remaining end of the anchor member by means of a loop. Stresses in the cable segments then do not act against each other through the anchor element as the bow is operated.

The eccentrics of most currently available compound archery bows may be visualized as a pair of cams, namely a take-up cam and a let-off cam, in approximately side-by-side relation so that an interface between them defines an imaginary plane which intersects the entire eccentric. In eccentrics embodied in accordance with this invention, the structural member supporting the anchor member is also intersected by the imaginary plane and the first and second chambers internal the eccentric are positioned opposite each other with respect to the imaginary plane. An excellent anchoring system utilizing such eccentrics is to pass the second end of the let-off cable segment from the let-off groove through the first passageway and across the imaginary plane to terminate in the first chamber located on the opposite side of the plane. It is then connected to the first end of the anchor element. The second end of the take-up cable is then fed from the take-up groove through the second cable passageway across the imaginary plane into the second internal chamber wherein it is attached to the second end of the anchor member. In this way, the grooves bearing on the cables tend to hold the anchor member and the terminal ends of the cables securely in their intended positions.

BRIEF DESCRIPTION OF THE DRAWINGS

In the drawings which illustrate what is presently regarded as the best mode for carrying out the invention.

DESCRIPTION OF THE ILLUSTRATED EMBODIMENT

Figure 1:
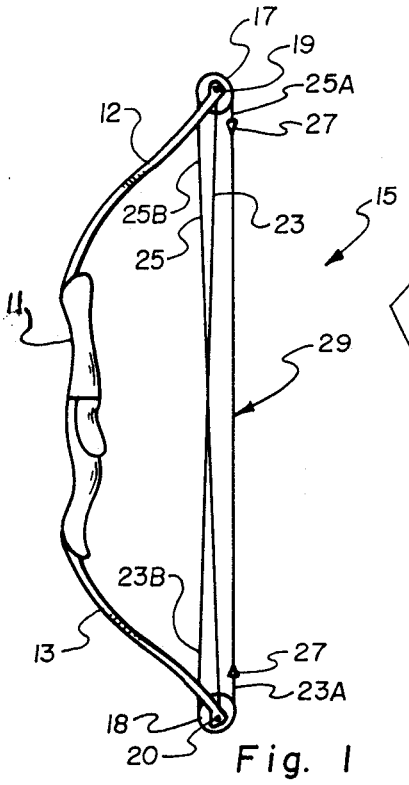
FIG. 1 is a schematic drawing of a typical compound archery bow.
Figure 2:
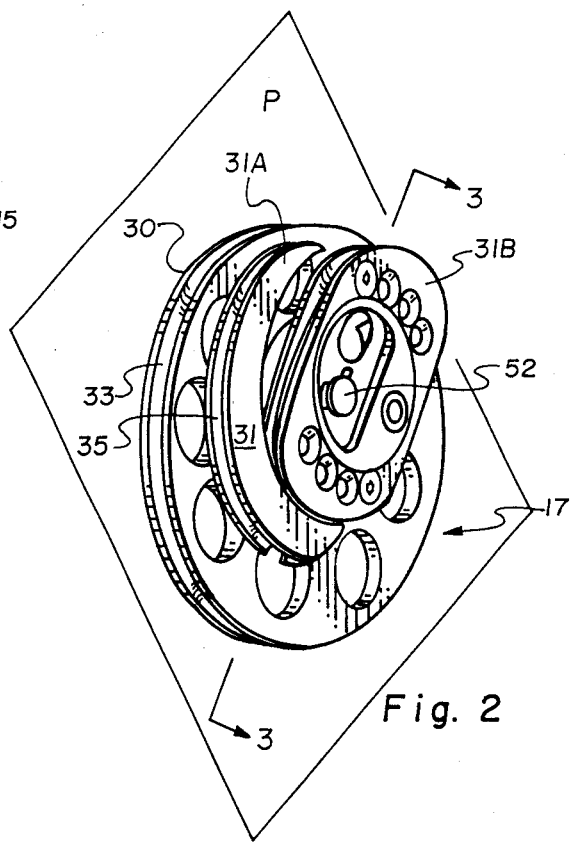
FIG. 2 is a pictorial view of a eccentric component of the rigging of this invention.
Figure 3:
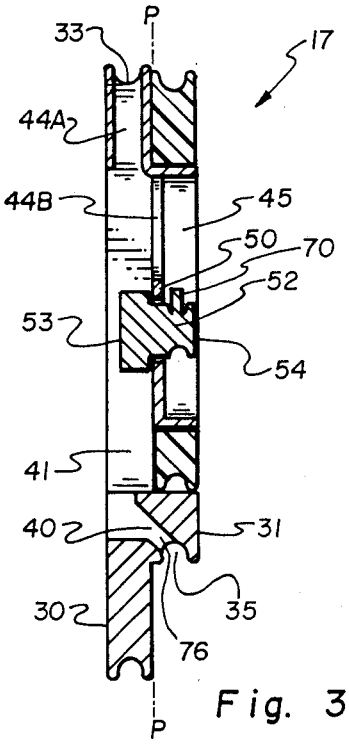
FIG. 3 is a cross-sectional view of the eccentric of FIG. 2 taken along the reference line 3—3 of FIG. 2.
Figure 4:
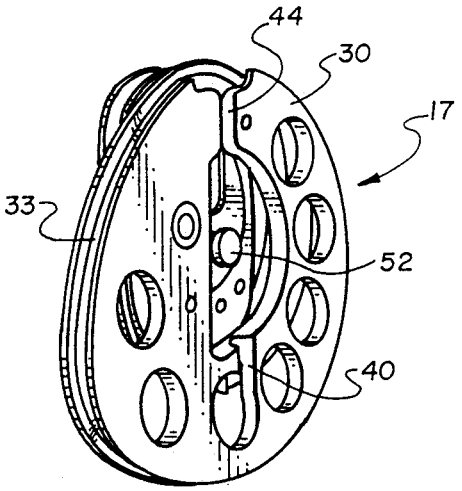
FIG. 4 is a pictorial view of the eccentric of FIG. 2 rotated approximately 180°.

The compound bow illustrated by FIG. 1 includes a handle riser 11, a pair of limbs 12, 13 extending from opposite ends of the handle riser 11, and rigging designated generally 15. Specifically, the rigging includes a pair of eccentrics 17, 18 mounted on axles 19, 20 at the ends of limbs 12 and 13, respectively. Associated with the eccentrics 17, 18 are a pair of cable end stretches 23, 25 connected by "tear drop" fixtures 27 carried at their respective ends to a bowstring 29. Each end stretch 23, 25 has a let-off portion 23A, 25A terminating in a "tear drop" fastener 27 and a take-up section 23B, 25B extending to attachment to the axle 19, 20, respectively, carried by the opposite limb. FIGS. 2 through 4 illustrate an eccentric of the type generally described and claimed by U.S. Pat. No. 4,774,927, but further adapted in accordance with the present invention. For purposes of this description, it is assumed that the eccentrics shown in FIGS. 2 through 4 is the upper eccentric 17 of FIG. 1. The lower eccentric is similar in structural detail but will be reversed in configuration, as is conventional practice in paired eccentrics for a compound bow.

Figure 8:
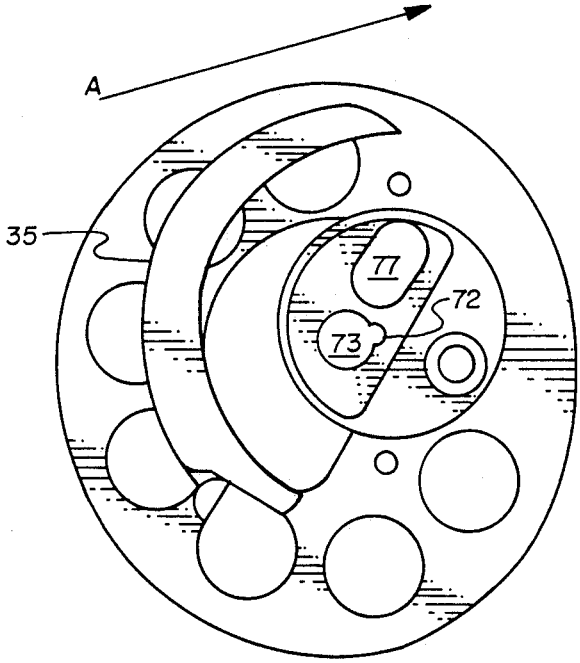
FIG. 8 is a side view of the opposite side of the eccentric of FIG. 2 with the take-up cam in the forefront, a portion of the take-up cam being removed.

FIG. 2 illustrates the eccentric with reference to an imaginary plane P defined by the interface between a let-off cam 30 and a take-up cam 31. A peripheral groove 33 extends around the entire perimeter of the cam 30 while a peripheral groove 35 extends around the perimeter of the cam 31. The take-up cam 31 is comprised of a fixed element 31A and a positionable element 31B. The positionable element 31B is removed from FIG. 8 for clarity of illustration. A first cable passageway 40 communicates between the peripheral groove 35 and a first chamber 41 (FIG. 2) internal of the eccentric 17. A second cable passageway 44 communicates between the peripheral groove 33 and a second chamber 45 internal eccentric 17. As illustrated, the second cable passageway 44 includes a first groove 44A extending from the groove 33 into the interior of the first interior chamber 41 and a bore 44B openly communicating between the chambers 41 and 45. A structural member 50, intersected by the plane P and integral with the eccentric 17, accommodates an anchor element 52 with a first end 53 located within the first chamber 41 and a second end 54 located within the second chamber 45.

Figure 5:
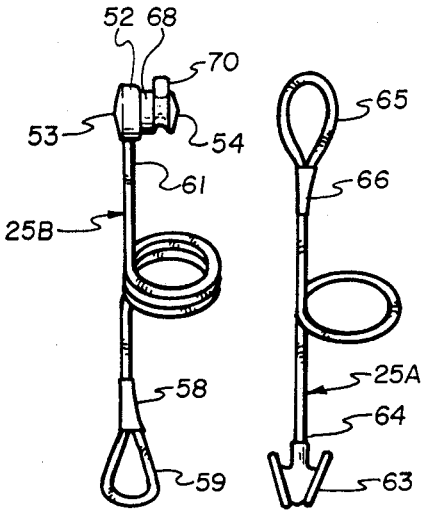
FIG. 5 is a pictorial representation of the end stretch cable segments of one embodiment of this invention.

The end stretch cable portions 25A, 25B are illustrated by FIG. 5 as separate segments. The cable portions 23A and 23B are substantially identical to their counterparts 25A, 25B, illustrated. The take-up segment 25B includes a first end 58 terminating in a loop 59 which may be anchored to the limb tip carrying the opposite eccentric as, for example, by means of the axle 20 (FIG. 1). A second end 61 of the segment 25B is illustrated fixed to an anchor member 52. The let-off segment 25A carries a "tear drop" fixture 63 at its first end 64 and a small loop 65 at its second end 66. The loop 65 connects to the groove 68 of the anchor member 52 as will be explained in more detail with reference to other figures of the drawings.

Figure 7:
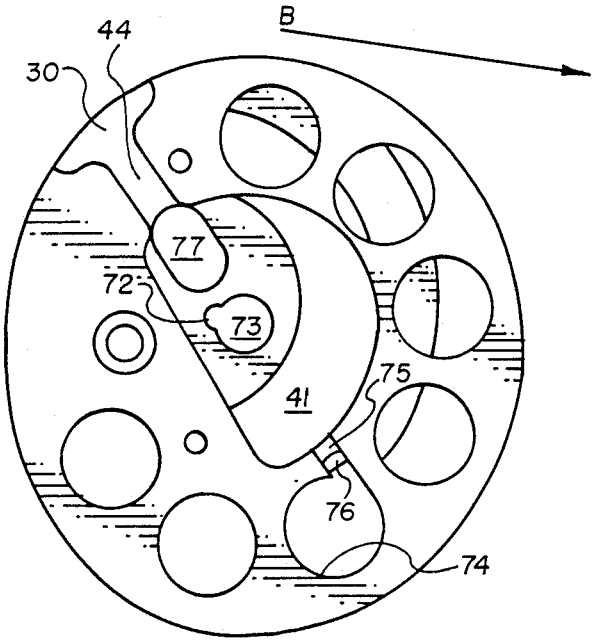
FIG. 7 is a side view of the eccentric of FIG. 2 with the let-off cam in the forefront.

The anchor member 52 carries a key structure 70 which functions as a registration structure for a corresponding slot 72 in an anchor passage 73 (FIG. 7).

Figure 6:
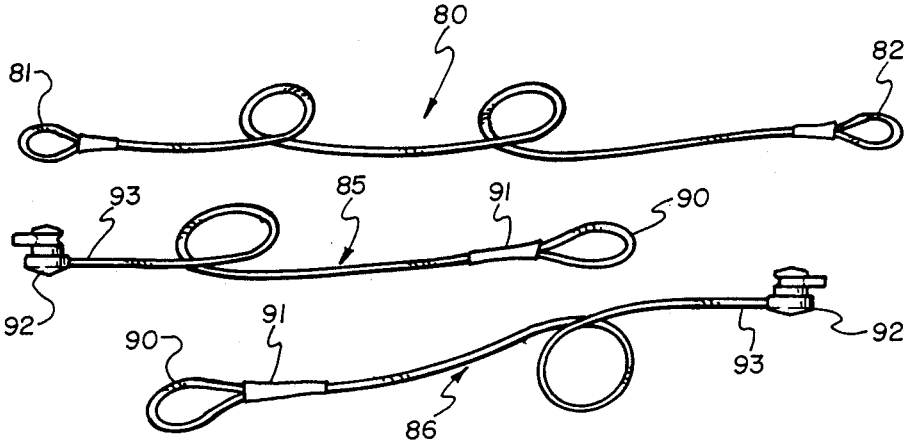
FIG. 6 is a pictorial representation of the cabling from another embodiment of this invention.

To assemble the rigging of this invention, the segment 25B is first connected to the eccentric 17. To do so, the anchor member 52 is inserted through the first hole 76 and chamber 41 into the anchor passage 73 with the key 70 in registration with the groove 72. The segment is then rotated to bring the cable end 61 into the cable passageway groove 75 and through the hole 76. The hole 76 merges with the passageway 40, as best seen in FIG. 3. The segment 25B is then wound around the peripheral groove 35 in the direction indicated A in FIG. 8, so that the loop 59 may be attached to the opposite limb tip as previously described. The end 66 of the segment 25A is positioned through the slot 44 with the loop 65 passing through the hole 77 for connection with the groove 68 at the end 54 of the anchor member 52. As so positioned, the key 70 is stradled by the loop 65. It is then wrapped around the groove 33 to extend in the direction indicated B on FIG. 7. Embodied as illustrated by FIG. 5, the tear drop 63 connects to a bowstring in conventional fashion. FIG. 6 illustrates a preferred embodiment which avoids the use of a tear drop altogether.

The anchor member 52 is fashioned generally as a cross-bolt with the first end 53 enlarged so that it cannot pass through the anchor passage 73. The groove 68 at the second end of the cross-bolt anchor member 52 functions to retain the cable loop 65 and restrain it against transverse movement. That is, it is held approximately adjacent the structural member 45.

It should be appreciated that either of the segments 25A or 25B (and/or their counterparts 23A, 23B) can be readily exchanged in the event of breakage or wear. Replacement can be done by an archer of modest mechanical skills without the need for professional assistance. Nor is it necessary to replace the entire rigging comprising eccentrics and end stretch cables in order to repair damage to a cable segment.

FIG. 6 illustrates the stretch portions of the preferred riggings contemplated by the invention. A central stretch segment 80 is provided with a pair of loops 81, 82. A pair of end stretches 85, 86 each carry loops 90 at their respective first ends 91 and permanently attached anchor members 92 at their respective second ends 93. The anchor members 92 are installed as previously described in connection with FIG. 5. The loops 81, 82 are then connected to the anchor members 92 as described in connection with the loop 65 of FIG. 5. Ideally, the end stretches 85, 86 are constructed of material such as aircraft cable which is characterized by relatively little stretch under tension. The central stretch 80 is preferably constructed of a multistrand yarn or fabric material, such as polypropylene, characterized by relatively silent high-speed operation.

Reference herein to details of the illustrated embodiments is not intended to restrict the scope of the appended claims which themselves set forth those features regarded as important to the invention.

I claim:

1. Rigging for a compound archery bow, comprising: a pair of eccentric elements, each including:

a take-up cam and a let-off cam in approximately side-by-side relation, each said cam having a cable-receiving peripheral groove about at least a portion of its perimeter;

an axle journal approximately transverse said take-up and let-off cams;

a first cable passageway between the peripheral groove of said take-up cam and a first chamber internal said eccentric and a second cable passageway between the peripheral groove of said let-off cam and a second chamber internal said eccentric, said first and second chambers each being accessible from outside said eccentric and being separated from each other by a structural member;

an anchor member journaled within an anchor passage through said structural member with a first end within said first chamber and a second end within said second chamber; and a pair of cables, each cable of said pair being associated with one of the eccentrics of said pair of eccentrics and including:

a take-up segment including a first end adapted for connection to structure associated with the other of said pair of eccentrics and a second end positioned from the peripheral groove of said take-up cam through said first cable passageway to said first chamber wherein it is connected to said first end of said anchor member; and a let-off segment including a first end associated with a bowstring and a second end positioned from the peripheral groove of said let-off cam, through said second cable passageway to said second chamber wherein it is connected to said second end of said anchor member.

2. Rigging according to claim 1, wherein said let-off segment is integral with said bowstring.

3. Rigging according to claim 2, wherein said second end of one of said let-off and take-up segments is permanently fixed to a said anchor member prior to positioning of said anchor member within said anchor passage, and said second end of the other of said let-off and take-up segment is removably attached to said anchor member after it is positioned within said anchor passage.

4. Rigging according to claim 3, wherein said second end of said take-up segment is permanently fixed to said anchor member.

5. Rigging according to claim 3, wherein said anchor member is rotatable within said anchor passage and carries first registration structure; said anchor passage includes second registration structure; and said first and second registration structures are cooperatively adapted so that said anchor member can pass from one to the other of said first and second chambers through said anchor passage only when said anchor member is rotated to a registration position and once positioned with its first and second ends in said first and second chambers, respectively, can be withdrawn through said anchor passage only when it is returned to a said registration position, the normal rotational orientation of said anchor member being other than in a registration position.

6. Rigging according to claim 5, wherein said anchor member is structured as a cross-bolt with one of its said first and second ends being configured such that it cannot enter said anchor passage and the other of its said first and second ends carrying said first registration structure.

7. Rigging according to claim 6, wherein said anchor passage is approximately circular in cross-section; said anchor member including a shaft of approximately circular cross-section positioned within said anchor passage, said first end of said anchor member is enlarged with respect to said cross-section of said anchor passage, and said second end of said anchor member carries a key projection constituting said first registration structure and said anchor passage includes a key slot constituting said second registration structure.

8. Rigging according to claim 7, wherein a second end of said let-off segment is formed in a loop placed around said second end of said anchor member adjacent said structural member.

9. Rigging according to claim 8, wherein said second end of said anchor element carries a groove arranged to receive said loop.

10. Rigging according to claim 1, wherein an interface between said take-up cam and said let-off cam defines an imaginary plane which intersects said structural member; said first chamber is positioned on the same side of said plane as is the let-off cam and said second chamber is on the same side of plane as is the take-up cam, whereby said second ends of said take-up and let-off segments both cross said plane.

11. Rigging according to claim 10, wherein said let-off segment is integral with said bowstring.

12. Rigging according to claim 11, wherein said second end of one of said let-off and take-up segments is permanently fixed to a said anchor member prior to positioning of said anchor member within said anchor passage, and said second end of the other of said let-off and take-up segments is removably attached to said anchor member after it is positioned within said anchor passage.

13. Rigging according to claim 12, wherein said second end of said take-up segment is permanently fixed to said anchor member.

14. Rigging according to claim 12, wherein said anchor member is rotatable within said anchor passage and carries first registration structure; said anchor passage includes second registration structure; and said first and second registration structures are cooperatively adapted so that said anchor member can pass from one to the other of said first and second chambers through said anchor passage only when said anchor member is rotated to a registration position and once positioned with its first and second ends in said first and second chambers, respectively, can be withdrawn through said anchor passage only when it is returned to a said registration position, the normal rotational orientation of said anchor member being other than in a registration position.

15. Rigging according to claim 12, wherein said anchor member is structured as a cross-bolt with one of its said first and second ends being configured such that it cannot enter said anchor passage and the other of its said first and second ends carrying said first registration structure.

16. Rigging according to claim 15, wherein said anchor passage is approximately circular in cross-section; said anchor member including a shaft of approximately circular cross-section positioned within said anchor passage, said first end of said anchor member is enlarged with respect to said cross-section of said anchor passage, and said second end of said anchor member carries a key projection constituting said first registration structure and said anchor passage includes a key slot constituting said second registration structure.

17. Rigging according to claim 16, wherein a second end of said let-off segment is formed in a loop placed around said second end of said anchor member adjacent said structural member.

18. Rigging according to claim 17, wherein said second end of said anchor element carries a groove arranged to receive said loop.

19. In a rigging system for a compound archery bow having an eccentric element comprising separate take-up and let-off cam members, said rigging system including a pair of cables and a bowstring of the type in which each cable is connected to said eccentric element so that a let-off cable segment extends from a let-off groove of said let-off cam member on one side of the eccentric element and a take-up cable segment extends from a take-up groove of said take-up cam member on the opposite side of the eccentric element, the improvement comprising:

providing each said cable in discrete segments, including a take-up segment with a first end adapter for attachment to structure associated with a compound bow and a second end carrying a cross-bolt fixture;

said cross-bolt fixture including a take-up end portion fixed to said second end of said take-up segment, a shaft portion extending from said take-up end portion and a let-off end portion extending from said shaft portion opposite said take-up end portion, said take-up end portion, shaft, and let-off end portion being formed as a single unit; and a let-off segment with a first end associated with a bowstring and a second end adapter for attachment to said let-off end portion of said cross-bolt.

20. An improvement according to claim 19, wherein said first end of said let-off segment is integral with a bowstring and said second end of said let-off segment is formed as a loop adapted to connect to said let-off end portion of said cross-bolt.

21. An improvement according to claim 19, including:

a first end stretch comprising a first said take-up segment;

a second end stretch comprising a second said take-up segment; and a central stretch comprising a bowstring with a first end comprising a first said let-off segment and a second end comprising a second said let-off segment.

22. An improvement according to claim 19, wherein said cross-bolt fixture is adapted to be releasably locked in said eccentric element by a retaining structure, said retaining structure being located generally within the seating channel of said eccentric element wherein said cross-bolt fixture is seated.

23. An improvement according to claim 22, wherein said retaining structure prevents movement of said cross-bolt fixture in a direction perpendicular to the plane in which said eccentric element lies.

24. An improvement according to claim 19, wherein said cross-bolt fixture formed as a single unit is fixed to either said let-off end segment or said take-up end segment.

* * * * *